United States Patent [19]

Hashimoto et al.

[11] Patent Number: 4,459,057

[45] Date of Patent: Jul. 10, 1984

[54] MECHANICAL PENCIL WITH AUTOMATIC LEAD ADVANCE

[75] Inventors: Junichi Hashimoto, Tokyo; Tomozo Sekiguchi, Kawasaki, both of Japan

[73] Assignee: Pentel Kabushiki Kaisha, Tokyo, Japan

[21] Appl. No.: 382,352

[22] Filed: May 26, 1982

[30] Foreign Application Priority Data

Jun. 12, 1981 [JP] Japan ..... 56-90368
Jan. 8, 1982 [JP] Japan ..... 57-1135

[51] Int. Cl.[3] ..... B43K 21/16
[52] U.S. Cl. ..... 401/53; 401/65; 401/67; 401/80; 401/81
[58] Field of Search ..... 401/53, 80, 81, 65, 401/67, 94

[56] References Cited

U.S. PATENT DOCUMENTS

| | | | |
|---|---|---|---|
| 2,911,948 | 11/1959 | Spector | 401/67 X |
| 3,880,530 | 4/1975 | Katz | 401/65 |
| 4,270,870 | 6/1981 | Hashimoto et al. | 401/65 X |
| 4,343,558 | 8/1982 | Fujiwara | 401/67 |

FOREIGN PATENT DOCUMENTS

| | | | |
|---|---|---|---|
| 2837586 | 3/1980 | Fed. Rep. of Germany | 401/65 |
| 2929855 | 3/1981 | Fed. Rep. of Germany | 401/65 |

*Primary Examiner*—Steven A. Bratlie
*Attorney, Agent, or Firm*—Wenderoth, Lind & Ponack

[57] ABSTRACT

A mechanical pencil with automatic lead advance in which a slider is temporarily locked at the time when a rearward thrust applied to the pencil tip is released. The slider is locked by an arrangement in which a movable locking tube is disposed around the slider. The locking tube can be inclined relative to the longitudinal axis of the pencil by a spring device so that the slider, when retracted, can be temporarily locked by the inclination of the locking tube.

11 Claims, 11 Drawing Figures

MECHANICAL PENCIL WITH AUTOMATIC LEAD ADVANCE

BACKGROUND OF THE INVENTION

The present invention relates to a mechanical pencil with automatic and manual lead advance, and more particularly to a temporary locking mechanism for a sleeve or slider for advancing a thin lead.

A mechanical pencil with automatic lead advance is known having a lead-protecting sleeve which surrounds the portion of the lead projecting from the tip of the pencil. As the lead wears away the sleeve automatically slides back into the body of the pencil. It has been suggested to combine the sleeve or slider structure with an automatic lead-feed mechanism inside the pencil. In this arrangement, the sleeve is spring-biased forwardly toward the writing tip. The lead projecting from the pencil tip is held in a slitted collet chuck. When the tip of the pencil is pressed against the writing paper, the lead is pushed backwardly, frictionally engaging the holder to clamp the lead. When the writing pressure is let up, the arrangement automatically advances the lead a tiny increment.

In the automatic lead-feed mechanical pencil, a rearward pressure applied to a sleeve of the slider or the lead projecting from the sleeve by pressing the projecting lead or a forward end of a slider sleeve against a writing paper forces the slider which holds the lead therein and a collet chuck mechanism into their retracted position. When the rearward pressure is released by lifting the pencil from the writing paper to permit the retracted elements to move into their original forward position, one of the slider and the collet chuck mechanism is temporarily held and the other one of them is first displaced into its forward position to advance the lead. Specifically, by temporarily holding the slider to permit the chuck mechanism to advance before the holding of slider is released, or by holding the chuck mechanism temporarily to permit the slider to advance before the holding of the chuck mechanism is released, an incremental advance of the lead is achieved so that lead projects from the forward end of the slider sleeve.

In such a mechanism, it has been suggested to employ locking engagement between locking jaws or a hook and a groove or grooves formed on the lead gripping holder or collet chuck. In this arrangement, however, stronger pressure should be successively applied to the slider sleeve for the purpose of disengaging the locking engagement, and in that case a forward movement of the collet chuck should be accelerated such that the jaws engaged with the groove can jump over the groove so as to prevent the jaws from reengaging with the groove. Accordingly, a rapid displacement or release of the pencil tip, which has been pressed against the writing paper for lead advancing, from the writing paper as well as a considerable strength of a spring for carrying out the jumping over the groove is required.

In order to improve the aforesaid pencil structure, the inventors of this application have suggested providing an annular elastomeric ring on the outer surface of the slider or the inner surface of a tubular pencil body, and an annular groove on the inner surface of the pencil body or the outer surface of the slider, as described in copending U.S. patent appln. Ser. No. 244,326, filed Mar. 16, 1981 now abandoned. This structure provides a desired temporary holding mechanism for advancing the lead. The inventors have carried out many experiments with the combination between the elastomeric ring and the groove, and have found that there is room for improvement in the sharpness and smoothness of instantaneous disengagement.

SUMMARY OF THE INVENTION

An object of the present invention is to provide an improved mechanical pencil with automatic lead advance, in which a slider is temporarily held in position at the time when a rearward thrust applied to the tip of the pencil is released.

Another object of the present invention is to provide an improved structure for temporary holding of the slider and for immediate and smooth release of the temporary holding.

Another object of the present invention is to provide an improved temporary holding mechanism of the slider, wherein immediately after a rearward thrust applied to the pencil tip and/or lead therein is released, the slider can be temporarily held in position and then displaced sharply into its forward normal position.

These objects are attained according to the present invention in an arrangement in which a movable locking tube is provided within the tubular pencil body and around the slider, the locking tube being inclinable relative to the longitudinal axis of the pencil, so that the slider when retracted can be temporarily held by the inclined locking tube. In accordance with the present invention, a locking tube is disposed between the tubular pencil body and the slider which is spring-biased forwardly by a spring. The locking tube can be inclined at a point where a fulcrum portion or member is formed. The fulcrum portion may be integral with the locking tube, or may be separate. When the locking tube is so formed, when it is inclined, the frictional resistance between the outer surface of the slider and the locking tube is greater than the spring force of the slider-biasing spring. At the back of the locking tube there is provided a pusher for abruptly contacting against and pushing forward the locking tube so that the locking tube will be displaced into its regular coaxial position after the slider is temporarily held by inclination of the locking tube.

A further object of the present invention is to provide a new mechanical pencil of the type described, in which the slider can be releasably locked in the rearmost retracted position so as to prevent the lead from accidentally projecting while the pencil is being carried.

The novel features of the invention which are considered characteristic of the invention are set forth in particular in the appended claims. The invention, however, both as its construction and its method of operation, together with additional objects and features thereof, will be best understood from the following description of specific and preferred embodiments when read in connection with the accompanying drawings.

DETAILED DESCRIPTION OF THE INVENTION

Figure 1:
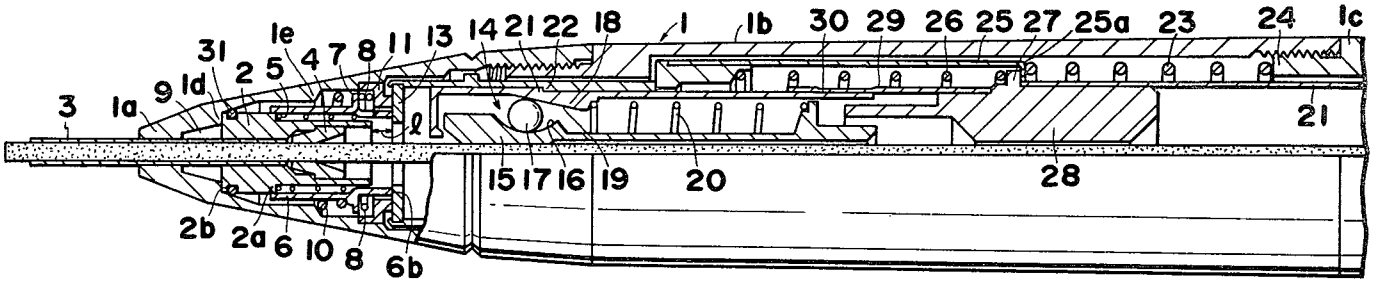
FIG. 1 is an enlarged, fragmentary, longitudinal sectional view of the pencil, showing the relative location of the parts in a writing condition with the writing lead projecting from the tip of the pencil.

Referring to the drawings, like reference numerals represent like parts in the different and various views of the drawings, and the rearward end portion of the pencil is not illustrated, being apparent from the description hereinafter and understood from the known mechanical pencils as well as from the following description.

Referring first to FIG. 1, a mechanical pencil has a slidable writing point tube 3 which is projectable from a central aperture of a tubular and generally cylindrical body or pencil casing designated generally at 1, and a slider 2 of a tubular shape having therein a tubular lead retainer 4. The slidable tube 3 and the slider 2 are slidably mounted within the casing 1 against the resilient force of a spring 5. The casing 1 has a front part 1*a*, middle part 1*b* and rear part 1*c*, the three parts being releasably connected to form a pencil casing as illustrated. The forward part 1*a* which has a front part in the shape of a truncated cone is centrally apertured to provide a tapered bore 9, shoulders 1*d* and 1*e*. The slider 2 is fixed to the slidable tube 3 and mounted within the forward part 1*a*. Within the slider 2 is provided the lead retainer 4 of desired resilient materials, which is designed to have the function of resisting reverse movement of a lead during slider retraction and to aid an advancing movement of the lead when the slider advances or travels in the forward writing point end direction. Accordingly, the lead retainer 4 which is annular shaped in the illustrated embodiment may be of any other desired shape such as a C-shaped ring, or otherwise the lead retainer may be omitted and instead a frictional engagement between the inner wall of the slidable tube 3 and the lead used to hold the lead in the slider. The slider 2 is axially slidable but generally urged by the spring 5 toward the writing tip so that the front end thereof abuts against the shoulder 1*d*. The spring 5 is mounted around the cylindrical portion of the slider 2, and between shoulder 2*a* of the slider 2 and a part of a locking tube 6 which will be described in detail.

Between the tubular pencil casing 1 and the slider 2 is disposed the generally cylindrical locking tube 6 which is designed to have a slider-retaining force greater than the recovery force of the spring 5. The locking tube 6 has an outwardly extended rim or receiver 7 engaged by a spring 10 supported on the shoulder 1*e*, and for receiving a fulcrum-former 8, which will be described, supported against a receiver 11 fixed to the pencil casing 1. The locking tube 6 is inclinable relative to the axis of the pencil casing 1 at the fulcrum point of the fulcrum-former 8, which is disposed between the receiver 11 and the receiver 7, by means of the spiral spring 10 which has starting and finishing ends in a consistent phase relation. The fulcrum-former 8 in the embodiment of FIGS. 1 through 4(C) may be selected from one of an annular leaf spring, a starting end of which lies on a finishing end thereof (FIG. 1), a ring having a rectangular cross section and in which the starting end lies on a finishing end as illustrated in FIG. 4(A), a steel ring a part of which is deformed as illustrated in FIG. 4(B), and a steel ball as illustrated in FIG. 4(C). It will be understood that the locking tube 6 which is biased rearwardly by the spring 10 will be inclined relative to the axis of the pencil casing at the fulcrum of the element 8.

Figure 5:
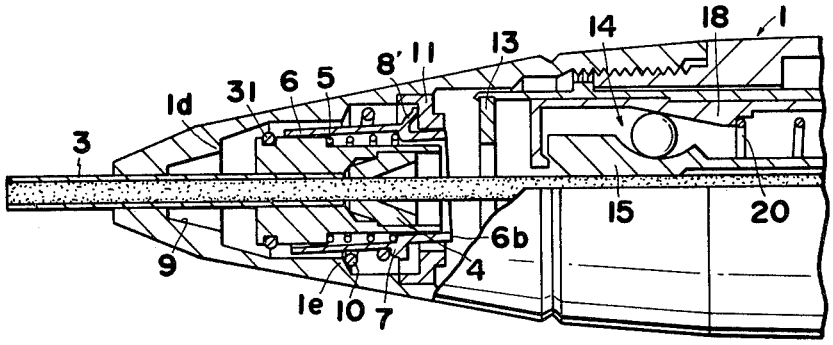
FIG. 5 is an enlarged, longitudinal sectional view of a front part of the pencil in accordance with another embodiment of the invention, showing the slider in a temporarily held position.

FIG. 5 shows a modified structure of the locking tube 6, in which the tube 6 has a spring receiver 7 on one side and a rearward projection 8′ on the other side. The projection 8′ functions as the fulcrum when it abuts against the receiver 11 under the force of the spring 10. Thus, the modified locking tube 6 can be inclined similar to the structure of the preceding embodiment.

Figure 6:
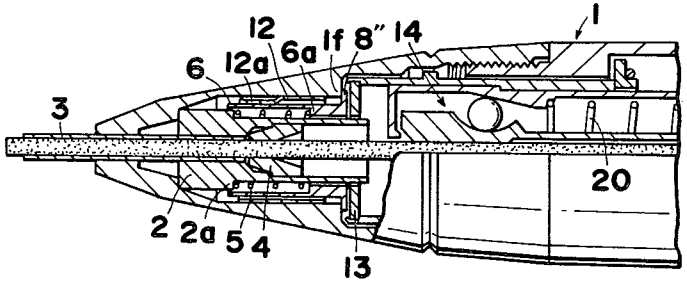
FIG. 6 is an enlarged, longitudinal sectional view of a front part of the pencil in accordance with a further embodiment of the invention, showing the slider in its forwardmost and unlocked position after the temporary holding of the slider is released.

FIG. 6 shows a locking tube 6 in accordance with another embodiment of the invention, in which inclination of the locking tube 6 is established applying by a force to a distal portion of the locking tube from the fulcrum, the force being substantially vertical to the axis of the pencil casing 1. In FIG. 6, a tube 12 is mounted between the inner wall of the pencil casing 1 and the locking tube 6. The locking tube 6 has a shoulder 6*a* abutted by one end of a spring 5, the other end of which engages a shoulder 2*a* of the slider 2, and an outward projection 8″ which will become a fulcrum in combination with a shoulder 1*f* of the pencil casing 1 when the locking tube 6 is inclined. The tube 12 has at its front portion an inwardly bent spring portion 12*a* to bias the slider 2 into an inclined position, in which the projection 8″ contacts the shoulder 1*f* to form a fulcrum. It will be understood that the projection 8″ corresponds to the projection 8′ of the locking tube 6 shown in FIG. 5.

Figure 2:
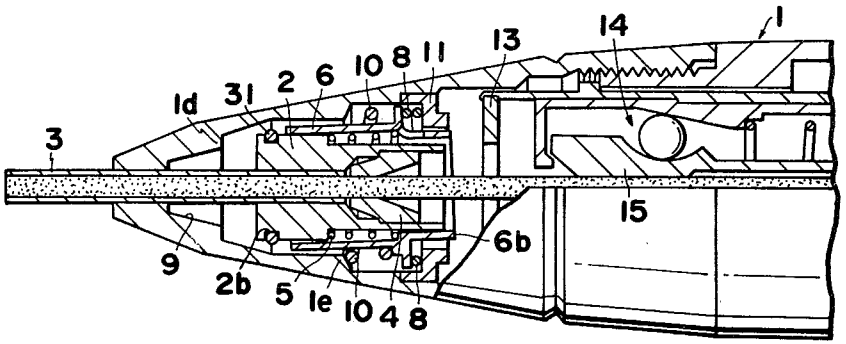
FIG. 2 is a further enlarged, longitudinal sectional view of a part of the pencil illustrated in FIG. 1, showing the relative location of the parts at the time when the tubular front tube or sleeve is in a retracted position along with the lead therein for the operation of lead advancing, and wherein the slider is temporarily held.
Figure 7:
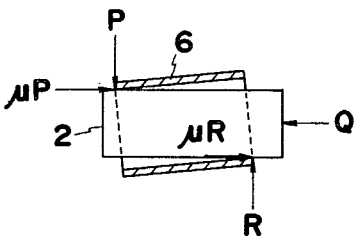
FIG. 7 is schematic view showing a fundamental mechanism for temporary holding of the slider.

The fundamental mechanism of the inclination of the slider 6 will be explained hereinafter with reference to FIGS. 1, 2 and 7. In FIG. 7 reference characters P and R designate forces applied perpendicularly to the axis of the slider 2, the forces P and R being applied to the surface of the slider when the locking tube is inclined by the force of the spring 10. The forces P and R are determined by the force of the spring 10 (in FIG. 1) or the spring force of the spring portion 12*a* (in FIG. 6). Reference character Q designates a forward thrust applied by the spring 5 to the slider 2, and reference character $\mu$ designates the friction coefficient at the mutual contact area of the slider 2 and the locking tube 6. If the thrust Q is greater than the friction forces due to forces P and R, namely under the condition of $Q > P + R$, the locking tube 6 will produce a damping effect, which however is too small to lock the slider 2 in position, and the slider will advance, resulting in a failure to advance the writing lead. By contrast, under the condition of $Q<P+R$, the slider 2 is held in position. Accordingly, in the present invention it is designed that the frictional resistance at the contact area of the slider 2 and the locking tube 6 be made greater than the sum of the force of spring 5 and a lead-retaining force of the retainer 4 mounted within the slider 2. At the rear of the locking tube 6 is positioned a pusher 13 which is spaced from the rear end 6*b* of the locking tube 6 in a normal position of FIG. 1 but collidable with the locking tube 6 to release the temporary holding of the slider 2. In order to enable the pusher 13 to collide with or push the locking tube 6 in the forward direction to release the slider 2 from its locking position and in order to enable the pusher to be in a spaced relation relative to the rear end 6*b* of the locking tube 6, the pusher 13 is connected to a collet chuck mechanism 14, which will be described in detail with reference to FIG. 1.

In FIG. 1, the collet chuck mechanism 14 is shown as comprising a lead engaging collet 15 incorporating a slitted collar and recessed seats 16 for holding rotary elements such as steel balls 17, a chuck-actuation cylinder 18 having a tapered guide surface 19, and a helical spring 20 mounted between the rear end of the collet 15 and the chuck-actuation cylinder 18. The collet chuck mechanism 14 is assembled such that the balls 17 received by the seats 16 will exhibit a "wedge" function relative to the tapered guide surface 19 of the chuck-actuation cylinder 18. The cylindrical pusher 13 is coaxially aligned with the slider 2 and fixed to the chuck-actuation cylinder 18. The pusher 13 is ordinarily spaced from the rear end of the slider 2 at a certain distance l, but engageable with the slider 2 to release the temporary engagement between the slider 2 and the locking tube 6 so that it can push the slider 2 in the forward direction when the collet chuck mechanism 14 is advanced from its retracted position. By the "wedge" effect of the balls 17 on the tapered surface 19 of the chuck-actuation cylinder 18, the lead gripping force of the collet chuck 15 is increased when a rearward force is applied for pushing the lead rearwardly into the pencil casing, while the wedging force is decreased when a force for pulling the lead out of the pencil casing is applied to permit the slitted collet chuck 14 be opened radially outwardly since the collet chuck 15 is advanced accompanying the lead grippd therein. Accordingly, though not shown, provided that the pusher 13 is formed integral with the chuck-actuation cylinder 18, the slider 2 will be retracted along with the lead when pressing the lead tip against a writing paper since the lead retaining force of the retainer 4 is greater than the spring force of the spring 5. Also the collet chuck mechanism 14, which is tightly holding the lead, and the pusher 13, which is assumed to be integral with the mechanism 14 as described above, are retracted together. Accordingly, the pusher 13 is spaced from the rear end of the locking tube 6 to immediately permit the locking tube 6, which has been regularly and coaxially aligned relative to the axis of the pencil casing 1, to be inclined automatically by means of the combination of the spring 10 and the fulcrum element 8. Thus, the slider 2 is temporarily held by the frictional engagement induced by inclination of the locking tube 6.

Figure 8:
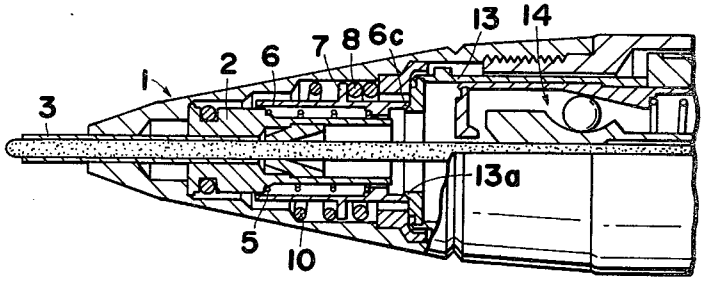
FIG. 8 is a longitudinal sectional view of a front part of the pencil according to another embodiment of the invention, showing the slider is in its forwardmost, unlocked position.

The spaced relation between the slider 2 and the pusher 13 will be explained. In FIG. 1, the distance l between the two elements 2 and 13 is maintained after the slider 2 and the pusher 13 are retracted for the purpose of a lead-advancing operation. When the thrust applied to the lead by pushing the pencil tip against the writing paper is immediately released by lifting the pencil tip above the paper, the slider 2 is still locked in position, and on the other hand, the collet chuck mechanism 14 is advanced to its original position along with the pusher 13. Thus, the collet chuck mechanism 14 is advanced until the pusher 13 abuts against the locking tube 6 in the locking position to release the slider 2 from its locked position, and such advance of the collet chuck mechanism 14 produces the intended advance of the lead. Then when the pusher 13 abuts against the rear end 6*b* of the inclined locking tube 6, the inclination is ended and the tube returned to the normal position as shown in FIG. 1 to release the frictional engagement between the slider 2 and the locking tube 6, and the slider with retainer 4 is immediately advanced to its original forward position along with the lead retained by the retainer 4. In order to assure the return of the inclined locking tube 6 to the normal coaxial position, an inclined surface 6*c* may be formed at the rear end of the locking tube 6 and a complementary shaped forward projection 13*a* correctly engageable with the inclined surface 6*c* may be formed at the front inner end of the pusher 13, as illustrated in FIG. 8.

As described above, for the automatic lead advance by pushing the lead and/or the slidable writing point tube 3 rearwardly into the pencil casing 1, it would be possible to form the pusher 13 integral with the chuck-actuation cylinder 18. However, such unitary structure of the pusher 13 and the chuck-actuation cylinder 18 will cause difficulty in the advancing operation of a new lead contained in a lead container 21. This is the reason why the pusher 13 in the present invention is formed separately so that it can be displaced independently and separately relative to the chuck-actuation cylinder 18.

In the present invention, the pusher 13 will be retracted rearwardly along with the chuck-actuation cylinder 18 at the time when the writing tip is pressed against the writing paper, and then the elements 15 and 18 of the collet chuck mechanism 14 can be advanced forwardly while the pusher 13 remains in position at the time of lead advancing actuation by pushing a button (not shown) at the rear end of the pencil. To this end, the chuck-actuation cylinder 18 is frictionally and slidably engaged with the rear portion of the pusher 13. The chuck-actuation cylinder 18 and pusher 13 have shoulders 21, 22, respectively, engageable with each other so that the pusher 13 will be retracted rearwardly along with the chuck-actuation cylinder 18 as described above. Further, the front end of the chuck-actuation cylinder 18 is spaced a certain distance from the pusher 13 at the time at which the pusher contacts the rear end 6*b* of the locking tube 6 as shown in FIG. 1.

A spring 23 is mounted between a shoulder 24 of the rear part 1*c* of the casing and a cylindrical receiver 25 of the pusher 13 so that the rear end of the pusher 13 is forwardly biased by the cylindrical receiver 25. Another spring 26 is mounted between the front inner end of the receiver 25 and a projection 27 of a cylindrical body 28 of the lead container 21 so that the projection 27 is spring-biased against the rear end 25*a* of the cylindrical receiver 25. The cylindrical body 28 of the lead container 21 has a friction tube 29 which is frictionally and slidably engaged at 30 with the rear end portion of the chuck-actuation cylinder 18. Thus, a new lead in the container 21 can be advanced by pushing the button at the rear end of the pencil.

Figure 3:
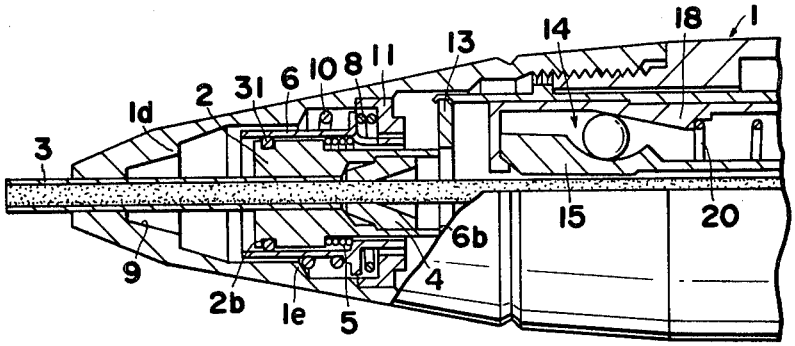
FIG. 3 is a view the same as FIG. 2 showing the relative location of parts at the time when the slider is releasably locked for preventing the lead from projecting accidentally when the pencil is carried in a pocket or the like of a user.
Figures 4A, 4B, 4C:
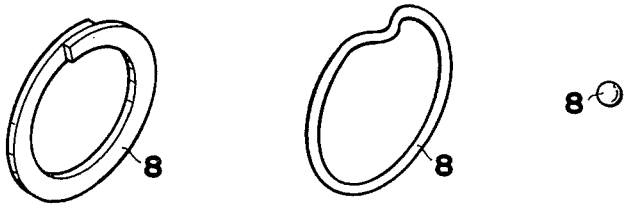
FIGS. 4(A), 4(B) and 4(C) are perspective views of elements applicable to the invention for achieving an inclination of a locking tube so as to temporarily hold the slider in position.

Referring to FIGS. 1 and 3, the slider 2 has at its front portion an annular groove 2b for mounting therein an annular elastomeric ring 31 so that the slider 2 can be retracted to its rearmost position by pushing the rear end button (not shown) to advance the collet chuck 15 to release the lead-gripping force thereof, and at the same time by pushing the pencil tip against the writing paper to retract the slider 2 until the slider 2 is releasably locked by the effect of frictional resistance between the inner surface of the locking tube 6 and the elastomeric ring 31. This prevents the slider 2 as well as writing tip tube 3 from being accidentally moved or retracted when it is carried in a pocket or the like of a user and contacted with some part of the pocket. If some thrust is applied to the writing tip tube 3 of the pencil, it will be understood from the foregoing description of the mechanism that the lead will accidentally be advanced.

According to the present invention, the locking tube 6 is disposed between the pencil casing 1 and the slider 2 and the locking tube 6 is inclined at its fulcrum to temporarily hold the slider 2 in its retracted position. At the rear of the locking tube 6, there is provided the pusher 13 which is spaced from the rear end of the locking tube 6 and collidable against the rear end of the locking tube 6 for releasing the temporary engagement between the slider 2 and the locking tube 6. Accordingly, when the rearward thrust or writing pressure applied to the lead is let up, the slider 2 is temporarily held at its retracted position by the frictional engaging force of the inclined locking tube 6, and then the temporary holding of the tube 6 is released by the advancing movement of the pusher 13 to permit the slider 2 to advance rapidly. Thus, an immediate and smooth lead-advancing operation can be established by letting up the writing pressure. In the embodiment shown in FIGS. 1 through 4(C) wherein the fulcrum for inclination of the locking tube 6 is made of a spring, steel ring or ball, difficulty or trouble in operation due to frictional wear or breakage of the fulcrum portion can be minimized.

Figure 9:
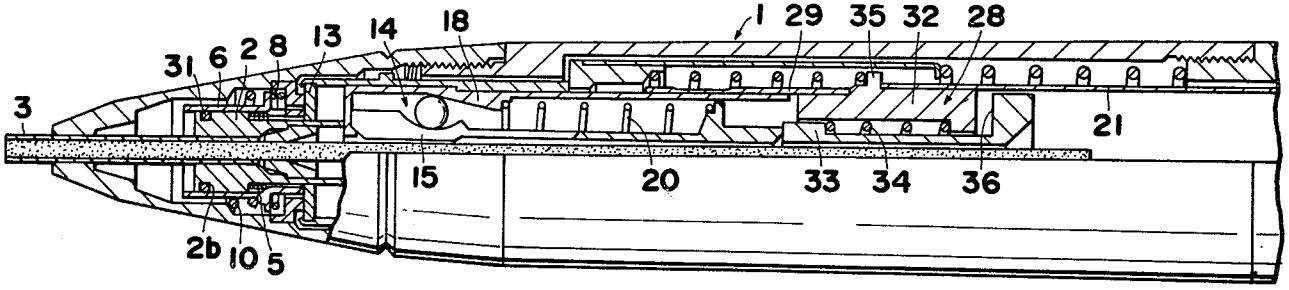
FIG. 9 is a fragmentary, longitudinal sectional view of the pencil according to another embodiment, showing the relative location of parts at the time when the slider is further retracted into the pencil casing and releasably locked for preventing the lead from accidentally projecting when the pencil is carried in a pocket and so forth of a user.

FIG. 9 shows a modified structure of the inner mechanism for permanently locking the slider 2 for the purpose of preventing the lead from being accidentally advanced when the pencil is carried in a pocket or a carrying-case.

When the pencil is to be carried, it is necessary that a backward thrust be added to fully retract the slider 2 for engagement with the elastimeric ring 31 while the rear end button is pushed to release the lead engagement force o the collet chuck 15. The elements, however, such as slider 2, pusher 13, collet chuck 15, cylindrical body 28, of the lead container 21 are coactively and directly contacted with one another, and therefore backward pressure is directly added to the rear end button which is being pushed forwardly by the user's finger. It is necessary for the user to successfully and gradually release the pressure on his fingertip in proportion to the retraction of the slider 2. This operation, however, requires the user's delicate and greatest care. The structure shown in FIG. 9 is a modified structure from that of FIG. 1.

In FIG. 9, the cylindrical body 28 consists of two parts, that is, an outer part 32 fixed relative to the lead container 21 and an inner part 33 movable but operatively connected relative to the lead container 21. A helical spring 34 is mounted between the fixed part 32 and the movable part 33. In this embodiment, the two parts retract together when the rear end button is pushed by a fingertip manipulation as if the two parts were a unitary structure, but on the other hand, the movable part 33 can be moved rearwardly separately by means of the spring force of the spring 34. The fixed part 32 has a projection 35 and is connected to the friction tube 29. The movable part 33 is disposed in a spaced confronting relation (not shown) relative to the end of the collet chuck 15 so that the movable part 33 can push and advance the collet chuck 15. Though not shown, when the slider 2 is in a normal unlocked condition, the front end of the movable part 33 is spaced from the rear end of the collet chuck 15, and the rear inner end of the movable part 33 is spaced from the rear end of the collet chuck 15, and the rear inner end 36 of the movable part 33 is contacted with the rear end of the fixed part 32.

The helical spring 34 is designed to have a spring force greater than the spring force of the collet chuck spring 20, so that when the rear end button (not shown) is pushed the collet chuck 15 can be advanced so as to be opened radially outwardly by the actuation of the movable part 33. However, the helical spring 34 should be so designed that it has a spring force smaller than the frictional engagement force of the elastomeric ring 31 mounted around the annular groove 2b of the slider 2.

It will be apparent from the foregoing description of the embodiment of FIG. 9 that when the slider 2 is forcibly retracted fully against the force of the spring 5 for the purpose of the releasable locking thereof by advancing the collet chuck 15 so that it is opened by manipulation of the rear end button, the pusher 13 pushes the movable part 33 rearwardly by way of the collet chuck 15, but the lead container 21 and therefore the rear end button are not retracted at all due to the compression of the spring 34. Besides, retraction of the chuck-actuation cylinder 18 will not retract the lead container 21 since the cylinder 18 is frictionally but slidably engaged with the friction tube 29 of the fixed part 32. Accordingly, an undesirable backward force or pressure accompanied by the retraction of the slider 2 is not added to user's finger which is in contact with the rear end button, and the permanent locking of the slider 2 is effected by simply pushing the writing tip of the pencil so that the slider 2 is retracted fully for engagement of the ring 31 with tube 6 while the pressure is applied to the rear end button by the fingertip operation.

Although, in FIGS. 3 and 9, the collet chuck 15 is shown to be slightly opened to release the lead in the releasable locking condition of the slider 2, the collet chuck may be retracted by the spring 20 to a position in which the chuck 15 can hold or grasp the lead.

Although the present invention has been described with reference to the preferred embodiments thereof, many modifications and alterations can be made within the spirit of the invention.

What is claimed is:

1. A mechanical pencil with automatic lead advance, comprising:

a tubular casing;

slider means slidably mounted in said tubular casing for movement along the longitudinal axis thereof and having a slider and a lead carrying tube in said slider projecting from one end of said casing and a lead retainer means in said slider for frictionally holding a writing lead therein;

first spring means urging said slider means forwardly toward said one end of said casing;

a collet chuck mechanism having a lead engaging collet, a chuck actuation device for actuating said lead engaging collet, and second spring means for urging said lead engaging collet and said chuck actuation device into lead engaging relationship for gripping the lead during a retracting of the lead by a rearwardly directed force on said lead carrying tube;

lead container means slidably mounted within said tubular casing and coactable with said chuck actuation device;

locking means engagable with said slider means for temporarily holding said slider means when said slider means is retracted to a predetermined position within said casing by a rearwardly directed force on said lead carrying tube, said locking means having a generally cylindrical locking tube positioned between the inner surface of said casing and the outer surface of said slider means, fulcrum means around which said locking tube is pivotable transversely to said longitudinal axis into an inclined position relative to said longitudinal axis and into frictional holding engagement with said slider means, and locking spring means engaged between said locking tube and the inner surface of said casing for pivoting said locking tube when said slider means is moved rearwardly against the resilient force of said first spring means for locking said slider means in the retracted position by the frictional holding engagement between said locking tube and said slider means; and pusher means frictionally slidably mounted on said chuck actuation device in a position for normally engaging said locking means to hold it in a non-inclined position and movable rearwardly away from said locking means with said collet chuck mechanism when a rearwardly directed force is exerted on said lead carrying tube, whereby when the rearwardly directed force on said lead carrying tube is released, said slider means is temporarily held in the retracted position while said collet chuck mechanism advances forwardly carrying the lead therewith until said pusher means engages said locking means to return it to the non-inclined position to release the frictional holding engagement between the locking means and said slider means, thereby causing an increment of the lead to project from the end of said lead carrying tube.

2. The mechanical pencil according to claim 1, in which said fulcrum means is rearwardly of said locking spring means, and said locking spring means in a helical spring mounted around said locking tube and engaged with and urging said locking tube rearwardly against and in pivotal movement around the fulcrum of said fulcrum means.

3. The mechanical pencil according to claim 2, in which said locking tube has a first projection extending rearwardly for engagement by said pusher means, and a second projection therearound engaged by one end of said helical spring.

4. The mechanical pencil according to claim 2, in which said fulcrum means is an annular member mounted around said locking tube, said annular member having a starting end which overlies the finishing end thereof to form a fulcrum around which said locking tube is pivotable.

5. The mechanical pencil according to claim 4, in which said locking tube has a projection therearound engaging one side of said annular member, and said tubular casing has an inwardly projecting portion against which the other side of said annular member engages.

6. The mechanical pencil according to claim 2, in which said fulcrum means is a generally annular member mounted around said locking tube, said annular member being deformed to form a fulcrum around which said locking tube is pivotable.

7. The mechanical pencil according to claim 2, in which said fulcrum means has a spherical member, said spherical member being a fulcrum around which said locking tube is pivotable.

8. The mechanical pencil according to claim 1, in which said locking spring means is a cylindrical member mounted between said locking tube and the inner surface of said tubular casing, and a spring-biasing portion at its forward end engaging said locking tube, and said fulcrum means is a projection on the rearward end of said locking tube and engaged with said casing to form a fulcrum for said locking tube.

9. The mechanical pencil according to claim 1, in which said slider means has an elastomeric ring mounted therearound for a frictional engagement with the inner surface of said locking tube when said slider means is forcibly retracted by a rearwardly directed force on said lead carrying tube while said collet chuck is pushed forward to release the lead therein, whereby said slider means is releasably locked in position within said tubular casing.

10. The mechanical pencil according to claim 1, in which said lead container means has a lead container tube and a cylindrical body frictionally and slidably engaged with said chuck-actuation device, and said cylindrical body has a first part fixed to said lead container tube, a second part movable relative to said first part of the cylindrical body, and a retracting force absorbing spring mounted between the first and second parts for absorbing the retracting force applied to said collet chuck mechanism so that substantially no retracting pressure is delivered to said cylindrical body.

11. The mechanical pencil according to claim 1, in which said locking tube has an inclined guide surface at its rear end, and said pusher means has at its front end a projection engageable with said guide surface.

* * * * *